United States Patent [19]

Nozawa et al.

[11] 4,139,981

[45] Feb. 20, 1979

[54] ESCAPEMENT MECHANISM FOR PENDULUM CLOCKS

[75] Inventors: Kazutoshi Nozawa, Tatsunomachi; Yasue Ashibe, Iigimamachi; Hatsuo Aruga, Minowamachi; Kunio Tatsuzawa, Ina, all of Japan

[73] Assignee: Rhythm Watch Company Limited, Tokyo, Japan

[21] Appl. No.: 755,550

[22] Filed: Dec. 30, 1976

[30] Foreign Application Priority Data

May 1, 1976 [JP] Japan ..... 51-50373

[51] Int. Cl.[2] ..... G04C 3/02; G04B 15/00

[52] U.S. Cl. ..... 58/123; 58/30; 58/124; 74/1.5

[58] Field of Search ..... 58/29-34, 58/129, 130 A, 131-134, 116 R, 123, 124; 74/1.5, 1.15

[56] References Cited

U.S. PATENT DOCUMENTS

| | | | |
|---|---|---|---|
| 197,832 | 12/1877 | Davies | 58/123 |
| 4,020,624 | 5/1977 | Steinle et al. | 58/123 |

*Primary Examiner*—Edith S. Jackmon

*Attorney, Agent, or Firm*—Koda and Androlia

[57] ABSTRACT

A pendulum clock mechanism may have an escapement coupled to a conventional pendulum bob by means of an anchor arbor which is frictionally or slip coupled to an anchor having at least a pair of pallet pins symmetrically disposed thereon for engagement to an escape wheel. The pallet pins engage the escape wheel in a conventional manner to regulate the operation of a conventional clock gear train. The anchor automatically rotates to a position of design equilibrium regardless of improper vertical installment of the clock or excessive torques applied to the escapement mechanism.

5 Claims, 10 Drawing Figures

ESCAPEMENT MECHANISM FOR PENDULUM CLOCKS

BACKGROUND OF THE INVENTION

1. Field of the Invention

The present invention relates to the field of pendulum driven clocks and in particular, relates to mechanisms which include means for self-adjusting the driving member of the escapement in response to misalignments of the clock mechanism with respect to the vertical.

2. Description of the Prior Art

As is well known in pendulum clocks, the periodic oscillation of the pendulum bob is used as the time keeping or regulating device. Such clocks have proven to be very efficient, reliable, simple and accurate when used as stationary wall clocks. Thus, such clocks, despite the age of their basic design are still widely accepted and employed. However, pendulum clocks still suffer from at least one major shortcoming. In order to obtain accurate and reliable time keeping operation, the clock must be installed and aligned along a designed orientation with respect to the vertical as defined by gravity. This condition arises for the most part from the operational characteristics of the escapement mechanism. For example, in conventional pendulum clocks, the relative position of the pendulum bob or pendulum arm and the anchor of the escapement mechanism are designed to assume a neutral or equilibrium position when the designed vertical of the excapement mechanism is aligned along the vertical as defined by gravity. The escapement mechanism operates in an optimum fashion when the pendulum clock is installed such that the designed vertical lies parallel to the gravitational vertical. When such an alignment occurs, the escapement mechanism operates with a minimum amount of error and a maximum degree of reliability. In this case, the anchor or ratchet of the escape wheel is in its proper escapement position.

However, if a conventional pendulum clock is installed in a position which is misaligned with the gravitational vertical, the equilibrium position of the pendulum arm or bob is aligned along an axis which is nonparallel to the designed vertical of the escapement mechanism. The motion of the pendulum bob in this case causes the anchor to oscillate in a nonsymmetrical fashion. In this improper positioning, the anchor will execute a periodic oscillation with respect to its corresponding escape wheel with a perturbation which is directly proportional to the angle of inclination between the designed vertical and the gravitational vertical. This perturbation is manifested as a change in the degree of engagement between the pallet pins of the anchor and the escape wheel. This perturbation, or improper engagement, is known as anshor sideswing and is a chief factor in time keeping inaccuracy in pendulum regulated clocks. In the extreme case, the improper engagement between the anchor and escape wheel may cause the escape mechanism to fail and cease keeping time. Understandably, such an extreme case results in a complete and functional failure of the pendulum clock.

Furthermore, another defect in conventional pendulum clocks is the vulnerability of the pallet pins to relatively mild shocks. Any undue stress exerted upon the pallet pins may either bend or break one or more of the pallet pins when the pallet pins strike the escape wheel with excessive force. Such an event may occur either due to anchor sideswing or when the pendulum is given a strong pull in order to start the periodic motions of the clock. Bending or breaking of the pallet pins may also be caused by erratic oscillation of the pendulum due to vibration or impulsive changes in speed when the clock is shipped or moved.

Therefore, what is needed is a means for overcoming each of the prior art shortcomings, to wit, a pendulum clock mechanism which will accurately keep time even though the designed vertical is misaligned with the gravitational vertical; which damage to the pallet pins is substantially prevented by reducing the stress or shock applied to the pallet pins; and which will be automatically self-adjusting to prevent anchor sideswing and damage during movement, starting, or shipment.

BRIEF SUMMARY OF THE INVENTION

The present invention is a clock mechanism comprising a pendulum; an escapement for controlling the speed and regularity of movement of the pendulum including an escape means for driving the escapement in a symmetric, periodic movement regardless of the disposition of the pendulum and the escapement with respect to the gravitational vertical; and coupling means for coupling the pendulum to the escapement. By virtue of this combination of elements of the present invention, the escapement executes a regular oscillatory movement regardless of any excessive force applied thereto either by accident or misalignment of the clock mechanism relative to the gravitational vertical. Moreover, by the same combination the clock mechanism of the present invention self-compensates and automatically adjusts for such misalignments.

In particular, the clock mechanism of the present invention has an escape means which includes an escape wheel having a plurality of escape teeth exposed on the periphery of the escape wheel; a rotatable pallet arbor disposed in a fixed relationship to the escape wheel; and an anchor disposed on the pallet arbor having at least two pallets for engagement with the escape teeth. The anchor is disposed on the pallet arbor in such a fashion that the anchor rotates relative to the pallet arbor whenever a torque greater than a predetermined torque is applied to the anchor.

These, and other advantages and specific embodiments of the present invention, may be better understood by viewing the following detailed description of the preferred embodiments in light of the figures.

DETAILED DESCRIPTION OF THE PREFERRED EMBODIMENTS

The present invention is an improved pendulum clock mechanism which contains an automatic adjusting device which self-adjusts the position of the anchor of an escapement mechanism such that the anchor will be in a optimum or designed position during the oscillation of the pendulum regardless of the exact alignment to the clock mechanism with respect to the gravitational vertical. The present invention includes an escape wheel having a plurality of escape teeth exposed on its circumference, an anchor having two pallets which are engageable with the escape teeth, a pallet arbor in which the anchor is exposed and to which the anchor is frictionally coupled so that the anchor will slip when a rotational torque larger than a predetermined torque is applied to the pallet arbor and the anchor, and a pendulum coupled to the pallet arbor to regulate the period of oscillation of the pallet arbor. The present invention is particularly characterized by the automatic regulation of the anchor to a proper or designed escapement position by causing the pallet arbor and the anchor to slip by means of the excess torque acting upon the anchor, typically produced by the improper placement of the pendulum clock with respect to the gravitational vertical.

Accordingly, the anchor will automatically slip into its proper designed position and will oscillate about the designed equilibrium position even when the pendulum clock has been installed in an improper position with respect to the gravitational vertical. Furthermore, damage to the pallet pins is substantially prevented by slippage of the anchor whenever a shock is applied to the pallet pins. In the present invention, accuracy of the clock is greatly simplified by virtue of fact a correct escapement position is obtained even when the pendulum clock is not installed in a proper position. Furthermore, in the present invention, adjustment for anchor sideswing is rendered unnecessary, thereby simplifying the assembly and installation of an accurate pendulum time piece. Finally, the likelihood of damage to the anchor or pallet pins during shipment of the clock is substantially reduced.

Figure 1:
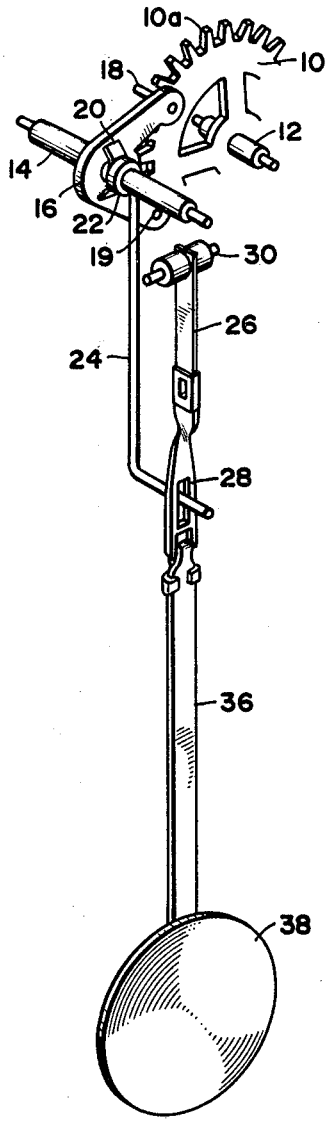
FIG. 1 is a diagramatic view of many of the material elements of the present invention showing the coupling between the pendulum and the escapement.

The operation of the present invention may be better understood by viewing FIGS. 1–10. In particular, FIG. 1 shows an escape wheel 10 mounted on an escape wheel arbor 12. A plurality of the escape teeth 10*a* are formed into the circumference of escape wheel 10. It is to be clearly understood that as is well known to the art escape wheel arbor 12 may be coupled by means of a pinion gear, not shown, disposed on arbor 12 and engaged with a conventional clock gear train and means for indication of time. A pallet arbor is disposed in a fixed relationship with respect to escape wheel 10, typically being rotatably mounted in a clock casement, and is mounted so that it can freely execute oscillatory motions. Anchor 16 is rotatably disposed on pallet arbor 14. Two pallet pins 18 and 19, which make up the pallets, are perpendicularly coupled, one to each end, of anchor 16. Pallet pins 18 and 19 engage escape wheel 10*a* in a conventional manner well known to the art in order to regulate and control the time keeping rotation of escape wheel 10.

Figure 2:
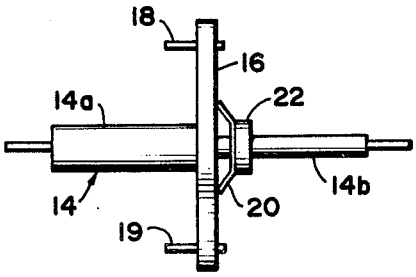
FIG. 2 is side view of the pallet arbor and anchor according to the embodiment as shown in FIG. 1.
Figure 3:
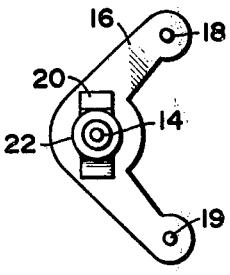
FIG. 3 is a frontal view of the embodiment as shown in FIG. 2

In the embodiments illustrated the pallet arbor 14 is frictionally coupled to anchor 16. One embodiment of such a frictional coupling is shown in greater detail in FIGS. 2 and 3. Pallet arbor 14 maybe comprised of a primary arbor portion 14*a* and secondary arbor portion 14*b*. Secondary arbor portion 14*b* is smaller in diameter than primary arbor portion 14*a* and anchor 16 is rotatably mounted on secondary arbor portion 14*b* and abutts primary arbor portion 14*a*. One side of anchor 16 may be held in contact with the step of pallet arbor 14 or the abutting face of primary portion 14*a*. The slip spring 20 is shown in FIGS. 2 and 3 as being in frictional contact with a side of anchor 16 disposed towards secondary portion 14*b* of pallet arbor 14. Slip spring 20 may be a compression type of metallic leaf spring having its central portion restrained by a stop ring 22 well known to the art. Stop ring 22 is fastened or coupled to secondary arbor portion 14*b* of pallet arbor 14. Thus, slip spring 20 is held in position by a compressive force developed beween anchor 16 and stop ring 22. Slip spring 20 produces a stable frictional slip torque between anchor 16 and pallet arbor 14. The frictional slip torque is designed to be slightly greater than the typical rotational torques experienced during regular escape action of anchor 16 and escape wheel 10. Therefore, during the regular oscillatory escape action, anchor 16 rotates as a unit with pallet arbor 14. When an impulsive or excessive torque is applied to arbor 14 and anchor 16, anchor 16 will slip on pallet arbor 14 against the frictional force provided by slip spring 20.

Figure 4:
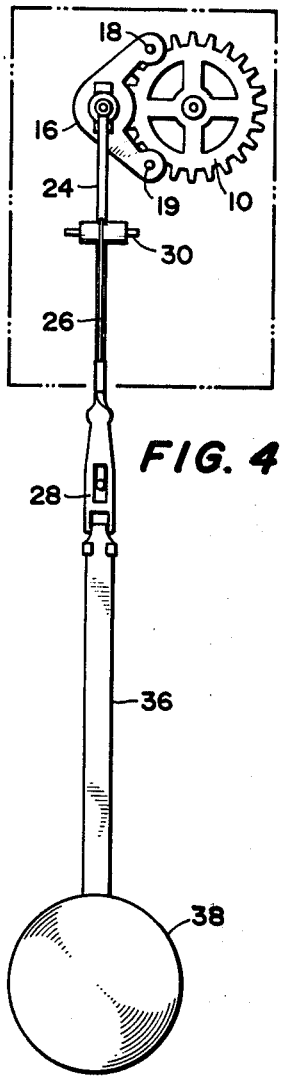
FIG. 4 illustrates the embodiment of FIG. 1 when the clock mechanism has its designed vertical aligned substantially along the gravitational vertical.

One end of anchor crutch 24 may be securely fastened or coupled to the secondary arbor portion 14*b* of pallet arbor 14. The other end of anchor crutch 24 is typically bent into an "L" shape and engages an opening 28 of swing rod 26. Swing rod 26 itself includes a leaf spring which is securely attached or coupled to a pendulum supporting post 30. Pendulum supporting post 30, as is well known to the art, is fastened to the movement case of the clock and defines the center of oscillation or swing of pendulum 38. Since swing rod 26 includes a leaf spring it is clearly designed to contrain oscillation of pendulum 38 in substantially a single plane. Oscillation in other planes is extremely difficult due to the high resistance to bending of swing rod 26. As shown in FIG. 4 swing rod 26 permits pendulum 38 to swing freely in the plane of the drawing but substantially prohibits any oscillation in a plane perpendicular to the drawing.

The method of operation of the present invention is better illustrated in connection with FIGS. 4–6. FIG. 4 illustrates the situation in which the pendulum clock of present invention is aligned substantially along the designed vertical of the clock mechanism. Rotational force of escape wheel 10 is transmitted to anchor 16 by means of pallet pins 18 and 19 of anchor 16. As a result, anchor 16 oscillates in a regular and equal manner in both directions from a designed mutual position. Torque produced by the oscillitory movement of anchor 16 is transmitted to pallet arbor 14 through the slip mechanism provided by slip spring 20. In this situation anchor 16 and pallet arbor 14 oscillate as an integral unit. The transmitted torque is of a stable magnitude. Clearly, the torque is transmitted to pallet arbor 14 without slippage of anchor 16 since the slip torque of the slipping mechanism is designed so that it is slightly greater than the torque normally produced by proper escape action. The oscillatory action and regulation of pendulum 38 is the same as a conventional escape action well known to the art. The oscillatory movement of pallet arbor 14 is transmitted to opening 28 on swing rod 26 through anchor crutch 24. As is well known, the swinging of pendulum bob 38 is maintained by the torque transmitted through anchor 16. Naturally, the rate of oscillation of the entire clock mechanism is regulated by well known physical principles inherent in pendulum oscillations.

Figure 5:
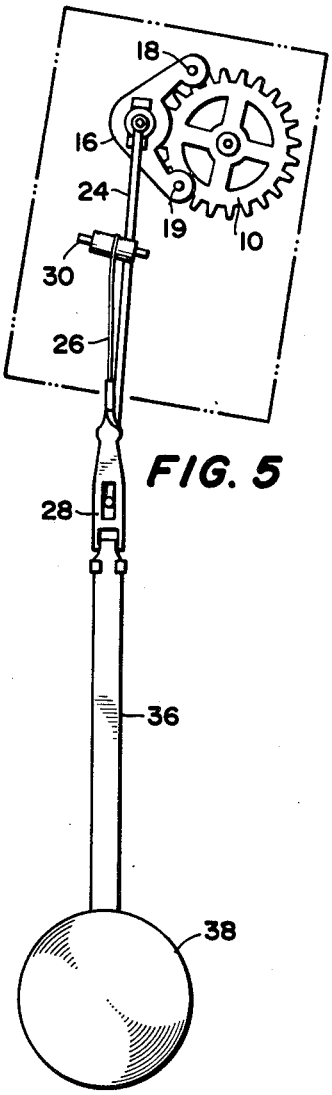
FIG. 5 illustrates the view of FIG. 4 when the clock mechanism has been rotated in a clockwise fashion with respect to the gravitational vertical.
Figure 6:
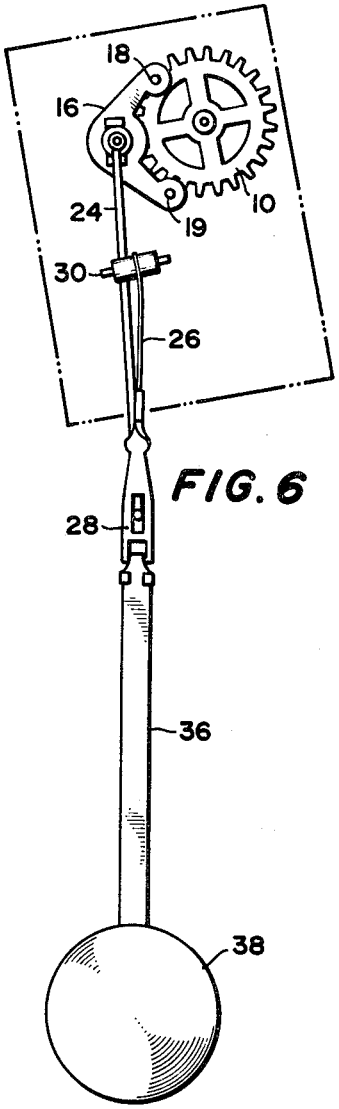
FIG. 6 illustrates the operation of the present invention when the clock mechanism in FIG. 4 has been rotated in a counterclockwise direction with respect to the gravitational vertical.

FIG. 5 is a diagramtic illustration of a situation in which a pendulum clock of the present invention is rotated in a clockwise direction with respect to the gravitational vertical. FIG. 6 illustrates the situation in which a pendulum clock of the present invention is rotated in a counterclockwise direction with respect to the gravitational vertical. In either case, it is clear from the above that the escape mechanism is positioned in a maladjusted situation in which anchor 16 will be caused to oscillate in a faulty manner termed as "side swing". However, the present invention is characterized by the automatic self-regulation of the position of anchor 16 for proper escape action by utilizing the excess torque arising from the maladjusted position, which torque acts upon the anchor such that the pallet arbor and anchor are rotated one with respect to the other to the desired designed equilibrium position. That is, even in the improper positions illustrated in FIGS. 5 and 6, pendulum bob 38 is maintain in a regular and symmetric oscillation by swing rod 26 and pendulum rod 36.

The reciprocating movement of pendulum bob 38 is transmitted to anchor 16 through pallet arbor 14. However, the proper reciprocating motion of pendulum bob 38 with respect to the gravitational vertical produces a biased torque which acts upon anchor 16. The biased torque is larger than the torque typically produced by the proper escaped action because anchor 16 is inclined from the designed vertical position. In the present invention, the slip torque of anchor 16 and pallet arbor 14 is designed such that it is smaller than the biased torque. In the position illustrated in FIGS. 5 and 6, the biased torque, which is larger than slip torque, is applied between anchor 16 and pallet arbor 14 until pallet arbor 14 is rotated to the position where proper escape action takes place given the misaligned orientation of the clock mechanism. When the angle of inclination of the gravitational vertical to the designed vertical of the clock mechanism is great, one of pallet pins 18 or 19 or anchor 16 itself may strike the bottom portions of escape teeth 10 during one of the reciprocating swings of pendulum bob 38. On such an occasion pallet arbor 14 and anchor 16 will slip by virtue of the biased torque such that the position of anchor 16 is automatically regulated and set in the correct position. After pallet arbor 14 and anchor 16 move to the proper position, the biased torque drops to the level of the regular escape torque and proper escape action begins in the misaligned situation. This corrective action is accomplished during only a few oscillations of the pendulum. Therefore, the error which results by virtue of such misalignment is extremely small for all practical purposes.

In the present invention, even when the clock mechanism is misaligned, automatic regulation takes place when the clock is started so that the anchor is corrected to the proper position of escape action and pallet pins 18 and 19 can obtain proper and balanced engagement with escape teeth 10*a*. As a result, the present invention prevents complete stoppage of pendulum bob 38 or error in indicated time caused by anchor side swing.

In the embodiment of FIGS. 1–6, pallet arbor 14 and anchor 16 were shown having a slip mechanism utilizing a slip spring 20. Slip mechanism may also be fabricated by substituting any know equivalent for slip spring 20 including a friction plate made out of suitable plastic.

Figure 7:
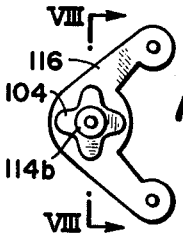
FIG. 7 is a front view of another embodiment of the present invention showing a multiple lobed resilient member coupling the pallet arbor and anchor.
Figure 8:
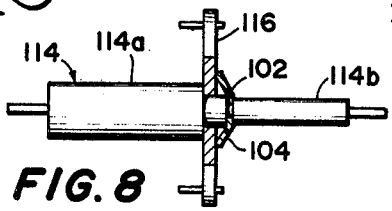
FIG. 8 is a side view of the embodiment as illustrated in FIG. 7.

FIGS. 7 and 8 illustrate another embodiment in the present invention in which the friction coupling mechanism between pallet arbor 14 and anchor 16 includes a multiple lobed compression spring. In the illustrated embodiments, pallet arbor 114 includes a primary arbor portion 114*a* and a secondary arbor portion 114*b* which is smaller in diameter than the primary arbor portion as shown in greater detail in FIG. 8, which is a cross-section taken through section VIII—VIII of FIG. 7. Anchor 116 if freely mounted or coupled to the secondary arbor portion 114*b*. A ring shaped groove is formed into secondary arbor portion 114*b*. The inside edge of a plastic slip ring 106 may then be pressed fit into groove 102. The outside edge of slip spring 104 is held in frictional contact with anchor 116 so that it produces a stable frictional slip torque between anchor 116 and pallet arbor 114.

Figure 9:
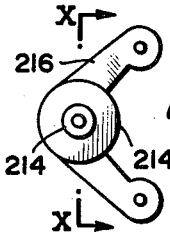
FIG. 9 is another embodiment of the present invention showing an injection molded arbor frictionally coupled to the anchor.
Figure 10:
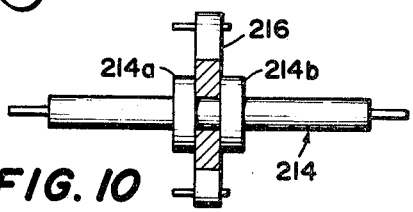
FIG. 10 is a side view of the embodiment of FIG. 9 showing the injection molded resilient members in frictional contact with the anchor.

FIGS. 9 and 10 illustrate yet another embodiment of the present invention wherein the friction coupling mechanism of the pallet arbor and anchor includes a pair of injection molded resilient shoulders. Pallet arbor 214 may be made of plastic material. The configuration illustrated in FIGS. 9 and 10 may easily be manufactured by the well known process of injection molding wherein a metalic anchor 216 is suitably disposed in an injection mold. Arbor 214 is then formed by injecting the desired plastic material about anchor 216. The desired frictional slip torque can be obtained between shoulders or flanges 214*a* and 214*b* as shown in greater detail in FIG. 10 which is taken through section X—X of FIG. 9. Shoulders 214*a* and 214*b* contract and press against each side of anchor 216 during the process of hardening and cooling following the injection molding step. The degree of frictional slip torque can then be set by proper choice of materials and design tolerances between anchor 216 and flanges 214*a* and 214*b*.

The present invention allows a frictional slip torque of the anchor and pallet arbor to be set at a predetermined magnitude. Generally, when the weight of the pendulum bob is fifty grams and the angle swing of the pendulum if five degrees from each side of the gravitational vertical, the magnitude of the slip torque is typically 8–30 gram centimeters while 16–20 gram centimeters is optimal. As described above, the anchor pallet arbor in the present invention are coupled by a slip mechanism which automatically moves the anchor to a proper operating position about the designed neutral or equilibrium configuration. Clearly, the present invention is characterized by the feature that when the pendulum clock has its designed vertical misaligned from the gravitational vertical, the pallet arbor and anchor will automatically slip relative to each other thereby causing a corrective action which is completed when they are engaged in a proper position according to the misalignment. As a result, the anchor and escape wheel obtain a proper and uniform engagement in virtually all installations without the need for any corrective action to be taken. In such a pendulum clock, the present invention prevents gross failure of the time keeping operation and error in indicated time due to anchor side swing. Although the present invention has been described in relation to the various embodiments of FIGS. 1–10, it is to be expressly understood that many alterations and modifications may be made by those having ordinary skill in the art without departing from the scope and spirit of the invention. Although frictional slip mechanisms have been principally described, it is to be understood that other types of slip mechanisms may also be employed and yet still be within the scope of the present invention. The embodiments illustrated have been chosen only for the purposes of illustration and clarification and are not to be understood as limiting the following claims.

I claim:

1. A clock mechanism comprising:

a pendulum;

an escapement for controlling the speed and regularity of movement of said pendulum including escape means for driving said escapement in a symmetric, periodic movement regardless of the disposition of said pendulum and escapement with respect to gravitational vertical, said escape means comprising:

an escape wheel having a plurality of escape teeth disposed on the periphery of said escape wheel;

a rotatable pallet arbor disposed in a fixed relation to said escape wheel;

an anchor disposed on said pallet arbor and having at least two pallets for engagement with said escape teeth, said anchor being disposed on said pallet arbor so that said anchor rotates about said pallet arbor whenever a torque greater than a predetermined torque is applied to said anchor; and a predetermined amount of frictional coupling maintained between said anchor and said pallet arbor by means of a resilient member; and coupling means for coupling said pendulum to said escapement, whereby said escapement executes regular oscillatory movement regardless of excessive torque applied thereto by accident and misalignment of said clock mechanism relative to the gravitational vertical and whereby self-compensating adjustments for said misalignments are automatically effected.

2. The clock mechanism of claim 1 wherein said resilient member is a multiple lobed leaf spring.

3. The clock mechanism of claim 2 wherein said leaf spring is of plastic.

4. The clock mechanism of claim 1 wherein said resilient member are shoulders formed on said pallet arbor, said anchor being disposed between said shoulders.

5. The clock mechanism of claim 1 wherein said coupling means includes a resilient swing arm coupled to a pivot point to substantially constrain movement of said pendulum to a predetermined plane.

* * * * *